US011359448B2

(12) United States Patent
Fripp et al.

(10) Patent No.: US 11,359,448 B2
(45) Date of Patent: Jun. 14, 2022

(54) BARRIER COATING LAYER FOR AN EXPANDABLE MEMBER WELLBORE TOOL

(71) Applicant: Halliburton Energy Services, Inc., Houston, TX (US)

(72) Inventors: Michael Linley Fripp, Carrollton, TX (US); Xiaoguang Allan Zhong, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/722,253

(22) Filed: Dec. 20, 2019

(65) Prior Publication Data

US 2021/0189817 A1 Jun. 24, 2021

(51) Int. Cl.

| | |
|---|---|
| ***E21B 23/04*** | (2006.01) |
| ***E21B 33/12*** | (2006.01) |
| ***E21B 23/01*** | (2006.01) |
| ***E21B 29/02*** | (2006.01) |

(52) U.S. Cl.

CPC ..... *E21B 23/04* (2013.01); *E21B 23/01* (2013.01); *E21B 33/12* (2013.01); *E21B 29/02* (2013.01)

(58) Field of Classification Search

CPC ..... E21B 23/04; E21B 23/01; E21B 33/12; E21B 29/02

See application file for complete search history.

(56) References Cited

U.S. PATENT DOCUMENTS

| | | | | |
|---|---|---|---|---|
| 4,527,815 | A * | 7/1985 | Frick | E21B 17/042 285/333 |
| 10,316,601 | B2 | 6/2019 | Walton et al. | |
| 2005/0199401 | A1 | 9/2005 | Patel et al. | |
| 2007/0221387 | A1 | 9/2007 | Levy | |
| 2008/0149351 | A1* | 6/2008 | Marya | E21B 23/00 166/387 |
| 2010/0181080 | A1 | 7/2010 | Levy | |
| 2014/0051612 | A1* | 2/2014 | Mazyar | C09K 8/516 507/269 |
| 2017/0022778 | A1 | 1/2017 | Fripp et al. | |
| 2017/0314372 | A1* | 11/2017 | Tolman | E21B 43/116 |
| 2018/0086894 | A1* | 3/2018 | Roy | C08J 5/00 |

FOREIGN PATENT DOCUMENTS

| | | | |
|---|---|---|---|
| WO | 2005022012 | A1 | 3/2005 |
| WO | 2019094044 | A1 | 5/2019 |
| WO | 2019147285 | A1 | 8/2019 |
| WO | 2019164499 | A1 | 8/2019 |

* cited by examiner

*Primary Examiner* — Dany E Akakpo
(74) *Attorney, Agent, or Firm* — Scott Richardson; Parker Justiss, P.C.

(57) ABSTRACT

Disclosed herein are aspects of a barrier coating layer of an expandable member wellbore tool for use in a wellbore. The barrier coating layer, in one aspect, covers at least a portion of the outer surface of the expandable member and has a composition formulated to react with a wellbore fluid and erode within a predetermined amount of time to allow a wellbore fluid to contact and hydrolyze the expandable member.

19 Claims, 5 Drawing Sheets

BARRIER COATING LAYER FOR AN EXPANDABLE MEMBER WELLBORE TOOL

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole tools, such as frac plugs, bridge plugs, packers, and other suitable tools, may be used to isolate wellbore sections.

These downhole tools are commonly run into the wellbore on a conveyance, such as a wireline, work string or production tubing. Such tools typically have either an internal or external setting tool, which is used to set the downhole tool within the wellbore and hold the tool in place, and thus function as a wellbore anchor. The wellbore anchors typically include a plurality of slips, which extend outwards when actuated to engage and grip a casing within a wellbore or the open hole itself, and a sealing assembly, which can be made of rubber and extends outwards to seal off the flow of liquid around the downhole tool. Notwithstanding the foregoing, today's wellbore anchors have a difficult time sealing off the roughened or scaled surfaces of the casing, as well as have difficulty in open hole scenarios.

BRIEF DESCRIPTION

Reference is now made to the following descriptions taken in conjunction with the accompanying drawings, in which.

DETAILED DESCRIPTION

Figure 1:
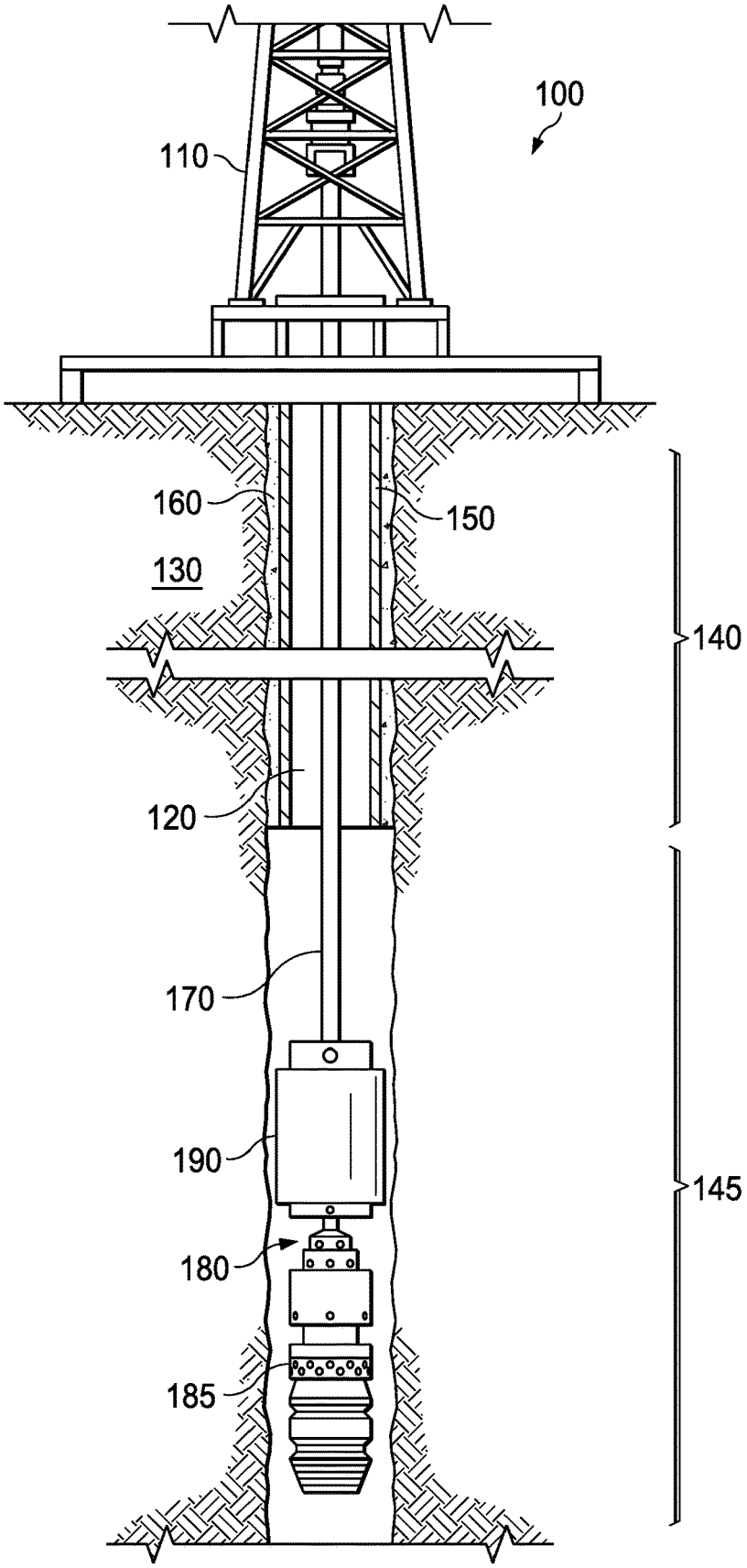
FIG. 1 is a perspective view of a well system including an exemplary operating environment that the apparatuses, systems and methods disclosed herein may be employed.

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

The embodiments of this disclosure provide a barrier coating layer applied to an expandable member that comprises a metal that hydrolizes when subjected to a wellbore fluid to form a hydrolyzed metal. The volume of the hydrolyzed metal is substantially larger than the volume of the original metal and, thus, the metal is chemically reacting as it expands in volume. The reactive metal is used to create a pressure seal or to create an anchor for downhole applications. The barrier coating layer has a variable corrosion rate when exposed to a wellbore fluid, thus acting as a delay trigger that postpones the reaction of the expandable member with the wellbore fluid and delays the hydrolyzation of the expandable member until a predetermined amount of time has lapsed. As the barrier coating layer is compromised, the metal reacts and expands to create a seal. This delay provides time to deploy and position the expandable member in the desired location within the wellbore. The barrier coating layer, as applied to the expandable member, provides a wellbore tool that is cost effective and one that provides a superior seal when compared to known solutions, such as swellable rubber packers. Further, no force is needed to activate the tool, thereby reducing the problems associated with downhole operation. An additional advantage is that it can be used in both cased or open hole operations.

Referring to FIG. 1, depicted is a perspective view of a well system 100 including an exemplary operating environment that the apparatuses, systems and methods disclosed herein may be employed. The well system 100 illustrated in FIG. 1 includes a drilling rig 110 extending over and around a wellbore 120 formed in a subterranean formation 130. As those skilled in the art appreciate, the wellbore 120 may be fully cased, partially cased, or an open hole wellbore. In the illustrated embodiment of FIG. 1, the wellbore 120 is partially cased, and thus includes a cased region 140 and an open hole region 145. The cased region 140, as is depicted, may employ casing 150 that is held into place by cement 160 and the rig floor or Xmas tree.

The well system 100 illustrated in FIG. 1 additionally includes a downhole conveyance 170 deploying a downhole tool assembly 180 within the wellbore 120. The downhole conveyance 170 can be, for example, tubing-conveyed, wireline, slickline, work string, or any other suitable means for conveying the downhole tool assembly 180 into the wellbore 120. In one embodiment, the downhole conveyance 170 is American Petroleum Institute "API" pipe.

The downhole tool assembly 180, in the illustrated embodiment, includes a downhole tool 185 and an expandable member 190. The downhole tool 185 may comprise any downhole tool that could be used in the wellbore 120. Certain downhole tools that may find particular use in the well system 100 include, without limitation, isolation devices, such as sealing packers, elastomeric sealing packers, non-elastomeric sealing packers (e.g., including plastics such as PEEK, metal packers such as inflatable metal packers, as well as other related packers), multilateral junction devices, liners, an entire lower completion, one or more tubing strings, one or more screens, one or more production sleeves, etc.

The wellbore tool 190, in accordance with the disclosure, includes one or more expandable members positioned on the downhole conveyance 170. In some embodiments, all or part of the wellbore tool 190 may be fabricated using an expanding metal configured to expand in response to a hydrolysis reaction. The expanding metal, in some embodiments, may be described as expanding to a cement like material. In other words, the metal goes from metal to micron-scale particles and then these particles expand and lock together to, in essence, lock The wellbore tool 190 in place. Depending on the barrier layer coating, as provided by this disclosure, the reaction may, in certain embodiments, occur in less than 2 days and up to 2 months, in a reactive fluid and in downhole temperatures. Nevertheless, the time of reaction may vary depending on the reactive fluid, the expandable metal used, and the downhole temperature. The expandable member 190 may be used in several ways. For example, it may be used as an isolation device, such as bridge plug, an annular isolation device, such as a packer, multilateral junction device, or an anchor, such as a packer, multilateral junction, or liner overlap. Moreover, the coatings can be applied to a large component, such as a cylinder that slide over an oilfield tubular or to a smaller component, such as gravel that flows as a slurry into a wellbore.

In some embodiments the reactive fluid may be a brine solution, such as may be produced during well completion activities, and in other embodiments, the reactive fluid may be one of the additional solutions discussed herein. The metal, pre-expansion, is electrically conductive in certain embodiments. The metal may be machined to any specific size/shape, extruded, formed, cast or other conventional ways to get the desired shape of a metal, as will be discussed in greater detail below. Metal, pre-expansion, in certain embodiments has a yield strength greater than about 8,000 psi, e.g., 8,000 psi+/−50%. The metal, in this embodiment, has a minimum dimension greater than about 1.25 mm (e.g., approximately 0.05 inches).

The hydrolysis of any metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reactions uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases.

In an embodiment, the metallic material used can be a metal alloy. The metal alloy can be an alloy of the base metal with other elements in order to either adjust the strength of the metal alloy, to adjust the reaction time of the metal alloy, or to adjust the strength of the resulting metal hydroxide byproduct, among other adjustments. The metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the alloy can be alloyed with a dopant that promotes corrosion, such as Ni—Nickel, Fe—Iron, Cu—Copper, Co—Cobalt, Ir—Iridium, Au—Gold, C—Carbon, gallium, indium, mercury, bismuth, tin, and Pd—Palladium. The metal alloy can be constructed in a solid solution process where the elements are combined with molten metal or metal alloy. Alternatively, the metal alloy could be constructed with a powder metallurgy process. The metal can be cast, forged, extruded, or a combination thereof.

Optionally, non-expanding components may be added to the starting metallic materials. For example, ceramic, elastomer, glass, or non-reacting metal components can be embedded in the expanding metal or coated on the surface of the metal. Alternatively, the starting metal may be the metal oxide. For example, calcium oxide (CaO) with water will produce calcium hydroxide in an energetic reaction. Due to the higher density of calcium oxide, this can have a 260% volumetric expansion where converting 1 mole of CaO goes from 9.5 cc to 34.4 cc of volume. In one variation, the expanding metal is formed in a serpentinite reaction, a hydration and metamorphic reaction. In one variation, the resultant material resembles a mafic material. Additional ions can be added to the reaction, including silicate, sulfate, aluminate, and phosphate. The metal can be alloyed to increase the reactivity or to control the formation of oxides.

The expandable metal can be configured in many different fashions, provided adequate volume of material is available for fully expanding. For example, the expandable metal may be formed into a single long tube, multiple short tubes, rings, alternating steel and swellable rubber and expandable metal rings, among others. Additionally, a coating may be applied to one or more portions of the expandable metal to delay the expanding reactions.

In application, the wellbore tool 190 can be run in conjunction with cup packers or wipers to reduce/control crossflow during reaction time. Additionally, the wellbore tool 190 may be run between multiple short swell packers or swell rings to also reduce cross flow during the reaction. Many other applications and configurations are within the scope of the present disclosure.

The downhole tool assembly 180 can be moved down the wellbore 120 via the downhole conveyance 170 to a desired location. Once the downhole tool assembly 180, including the downhole tool 185 and the wellbore tool 190 reach the desired location, the wellbore tool 190 may be set in place according to the disclosure. In one embodiment, the wellbore tool 190 is subjected to a wellbore fluid sufficient to cause a timed corrosion of the barrier coating layer that ultimately allows the wellbore fluid to reach the expandable member, thereby causing it to expand and come into contact with the walls of the wellbore 120 and thereby anchor or seal the one or more downhole tools within the wellbore 120.

In the embodiment of FIG. 1, the wellbore tool 190 is positioned in the open hole region 145 of the wellbore 120. The wellbore tool 190 is particularly useful in open hole situations, as the expandable member is well suited to adjust to the surface irregularities that may exist in open hole situations. Moreover, the expandable member, in certain embodiments, may penetrate into the formation of the open hole region 145 and create a bond into the formation, and thus not just at the surface of the formation. Notwithstanding the foregoing, the expandable member wellbore anchor 190 is also suitable for a cased region 140 of the wellbore 120.

Figure 2:
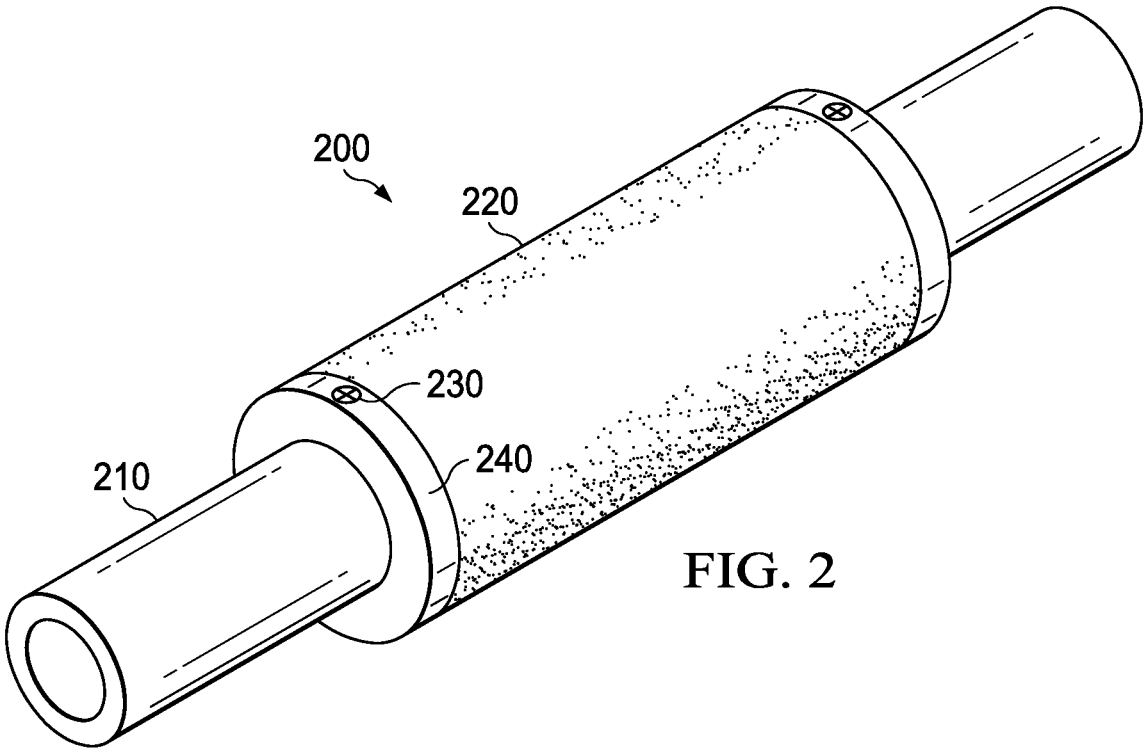
FIG. 2 illustrates one embodiment of a configuration of the expandable member wherein the expandable member is a single unitary member.

FIG. 2 illustrates an embodiment of an expandable member designed and manufactured according to the disclosure. The illustrated embodiment of FIG. 2 illustrates an expandable member wellbore tool 200. In accordance with the disclosure, the expandable member wellbore tool 200 includes an expandable member 220 positioned on a downhole conveyance member 210. Though only one expandable member 220 is shown in FIG. 2, other embodiments of the wellbore anchor 200 may include more than one expandable member 320, as shown generally in FIG. 3. Further, while the downhole conveyance member 210 illustrated in FIG. 2 is API pipe, other embodiments may exist wherein another type conveyance is used.

The expandable member(s) 220, 320, in accordance with the disclosure, comprise a metal configured to expand in response to hydrolysis, as discussed in detail above. Furthermore, a combined volume of the one or more expandable members 220, 320 should be sufficient to expand to anchor one or more downhole tools within the wellbore in response to the hydrolysis. In one embodiment, the combined volume of the one or more expandable members 220, 320 is sufficient to expand to anchor at least about 11,000 Kg (e.g., about 25,000 lbs.) of weight within the wellbore. In yet another embodiment, the combined volume of the one or more expandable members 220, 320 is sufficient to expand to anchor at least about 22,000 Kg (e.g., about 50,000 lbs.) of weight within the wellbore, and in yet another embodiment sufficient to expand to anchor at least about 27,000 Kg (e.g., about 60,000 lbs.) of weight within the wellbore.

Figure 3:
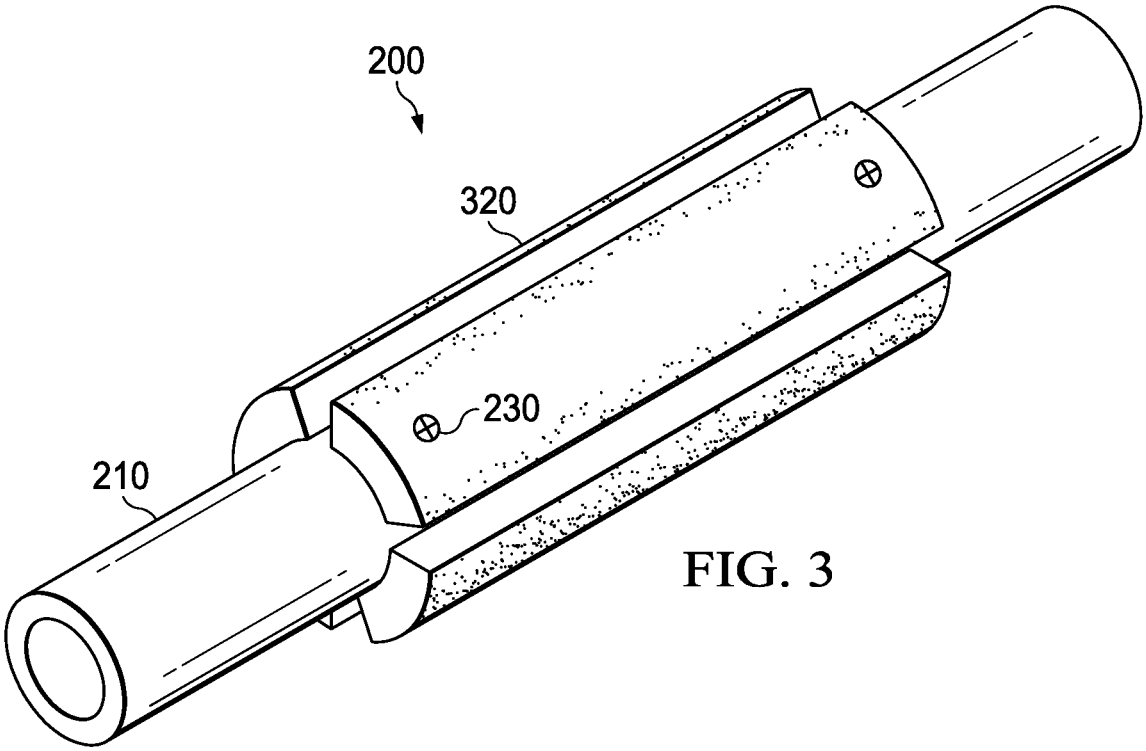
FIG. 3 illustrates another embodiment of a configuration of the expandable member where the expandable member is comprised of multiple expandable members.

The one or more expandable members 220, 320 are axially positioned along and substantially equally radially spaced about the downhole conveyance member 210. In the illustrated embodiment, the one or more expandable members 220, 320 include openings extending entirely through a wall thickness thereof for accepting a fastener 230 (e.g., a set screw in one embodiment) for fixing to the downhole conveyance member 210. As those skilled in the art now appreciate, the one or more expandable members 220, 320 will expand to engage the walls of the wellbore when subjected to a suitable fluid, including a brine-based fluid, and thus function as one of the tools noted above. In alternative embodiments, a retaining ring 240 may be used to secure the one or more expandable member 230, 320 to the downhole conveyance member 210. FIG. 3 illustrates one embodiment of multiple expandable members 320, but other expandable member configurations may be used. For example, the expandable members 320 may be any number of toroidal expandable members positioned around the downhole conveyance member 210 that are separated by spacers and one or more of the above-mentioned fasteners.

In an alternative embodiment, the expandable member wellbore tool 200 includes a swellable rubber member positioned between a pair of expandable members and that is configured to swell in response to contact with one or more downhole reactive fluids to pressure seal the wellbore, as well as function as a wellbore anchor. In one embodiment, the reactive fluid may be a diesel solution, or other similar water-based solution.

Figure 4:
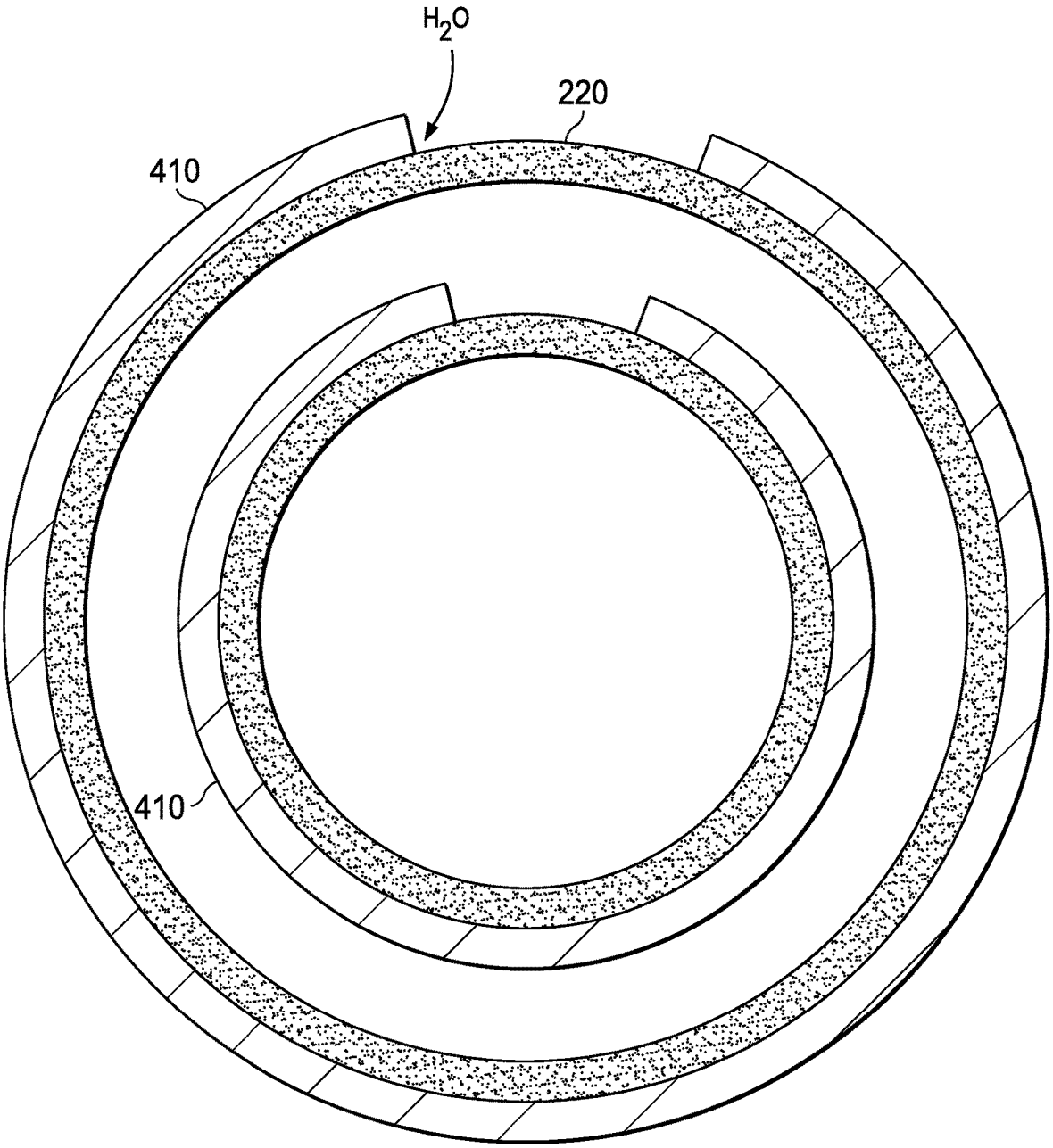
FIG. 4 illustrates an embodiment where the barrier layer coating covers at least a portion of the expandable member.

In FIG. 4, the various embodiments of the expandable member 220 include a barrier layer 410 that in one embodiment, covers at least a portion of the expandable member 220, as generally shown in FIG. 4. However, in other embodiments, as discussed below, the barrier coating layer 410 covers all the outer surface of the expandable member 220 that would be exposed to the wellbore fluid when positioned in a wellbore. The barrier coating layer 410 has a composition formulated to react with a wellbore fluid and erode within a predetermined amount of time to allow the wellbore fluid to contact and hydrolyze the expandable member 220. It's understood that given enough time, many types of materials have a natural rate of erosion when exposed to a wellbore fluid environment. However, as used herein and in the claims, "a predetermined amount of time" means a period of time that is less than a natural rate of erosion and is one where the selection and/or application of the material(s) of the barrier coating layer 410 is made to provide a barrier coating layer 410 that erodes within a selected period of time during which a well completion, workover, or other operation is completed. For example, the predetermined amount of time may range from several hours up to two months. The amount of time delay in erosion can be based on one or more physical characteristics of the material comprising the barrier coating layer 410. For example, the erosion rate may be based on the permeability of the barrier coating layer 410, the type of material(s) used in the barrier coating layer 410, the porosity of the barrier coating layer 410, or any combination thereof. In some embodiments, the barrier coating layer 410 may be comprised of multiple coatings comprising different materials, as explained in more detail below. Additionally, other physical properties that can be considered are the thickness of the barrier coating layer 410 or its responsiveness to temperature that can cause an accelerated rate or erosion. For example, the thickness of the barrier coating layer 410 may range from about 0.1 mm to about 2.0 mm, and the temperature may range from about 150° F. to about 350° F.

In one embodiment, the barrier coating layer 410 comprises a metal, a ceramic, an organic compound, a polymer, or combinations thereof. In those embodiments where the barrier coating layer 410 comprises a metal, the metal is nickel, gold, silver, titanium, chrome, or a combination thereof. In one aspect of this embodiment, the metal is nickel, and the nickel has a residual porosity; that is, it has different porosities within metal. Thus, the residual porosity can be tailored such that the erosion or degradation of the barrier coating layer 410 occurs at different rates within the metal. For instance, in one embodiment, the residual porosity provides a first rate of delay, for example, a 4 hour delay, before the onset of expansion and a second reduce rate of delay, for example, a 10 hour delay, before the onset of expansion when exposed to a wellbore fluid, totaling a 14 hour delay before the wellbore fluid hydrolizes the expandable member 220. In one embodiment where nickel is used, the nickel may be an electroless nickel that can be a layered nickel-phosphorus or nickel-boron. In those embodiments where the barrier coating layer 410 comprises a ceramic, the ceramic, for example, is zirconium dioxide or other ceramic materials having similar properties. Examples of organic coatings include sorbitan monooleate, glycerin monoricinoleate, sorbitan monoricinoleate, sorbitanmonotallate, pentaerythritol monoricinoleate, sorbitan monoisostearate, glycerol monostearate, sorbitan monostearate, or mixtures thereof. In another example of layering, a strike or flash, which is a known plating technique, can initially be placed on the reactive metal. This plating layer forms a strong bond to the base metal that allows for the thicker layers to be quickly applied.

In another embodiment, the barrier coating layer 410 comprises a polymer. Examples of the types of polymer that can be used include rubber, epoxy, plastics, such as polylactic acid, poly(glycolic acid), low density polyethylene, high density polyethylene, polypropylene, or urethane plastic. In one aspect of this embodiment, the polymer comprises a relatively high crystalline polymer that is substantially impermeable to the wellbore fluid at lower temperatures. However, at elevated temperatures, the polymer becomes substantially permeable to the wellbore fluid when heated to a crystallization temperature of the polymer. Crystallization temperatures of common polymers are known and can be conveniently measured by techniques, such as differential scanning calorimetry. In some embodiments, the barrier layer coating 410 has a permeability that changes with time. In such embodiments, the permeability is very low so that the water passing through the coating roughly balances the departing gas. As the permeability of the barrier layer coating 410 changes with time, increasing amounts of water can enter. The result is that the destruction of the barrier coating layer 410 accelerates. Thus, a more rapid transition from "no expansion" to "rapid expansion" of the reactive metal can be achieved.

Polymers can be engineered to have certain desired crystallization temperatures and levels of crystallinity. Thus, the barrier coating layer 410 can be constructed using a polymer having a crystallization temperature that is somewhat less than the temperature to which it is expected to be exposed when appropriately positioned in a well. As such, the barrier coating layer 410 will become permeable to the wellbore fluid before the expandable member 220 is in its desired position in the wellbore. In one embodiment, the polymer is at least 30% crystalline when it is desired for the polymer to be substantially impermeable to the wellbore fluid. Examples of suitable polymers in such embodiments that may be used include low density polyethylene, high density polyethylene and polypropylene. Of course, combinations of different polymers may be used, if desired.

In some embodiments, the polymer is hydrolytically degradable, which allows the degradation of the barrier layer coating 410 to change with time. Examples of such embodiments comprise polylactic acid, poly(glycolic acid), swellable rubbers, or urethane plastics. When exposed to the wellbore fluid, the permeability of these materials increases with continued exposure to water-based fluids. In these instances, the erosion/degradation of the barrier coating layer 410 may start out slow and gradually increase the longer it is exposed to the wellbore fluid. Thus, the physical properties of the selected material can be used to create a barrier coating layer with the desired amount of erosion delay.

Figure 5:
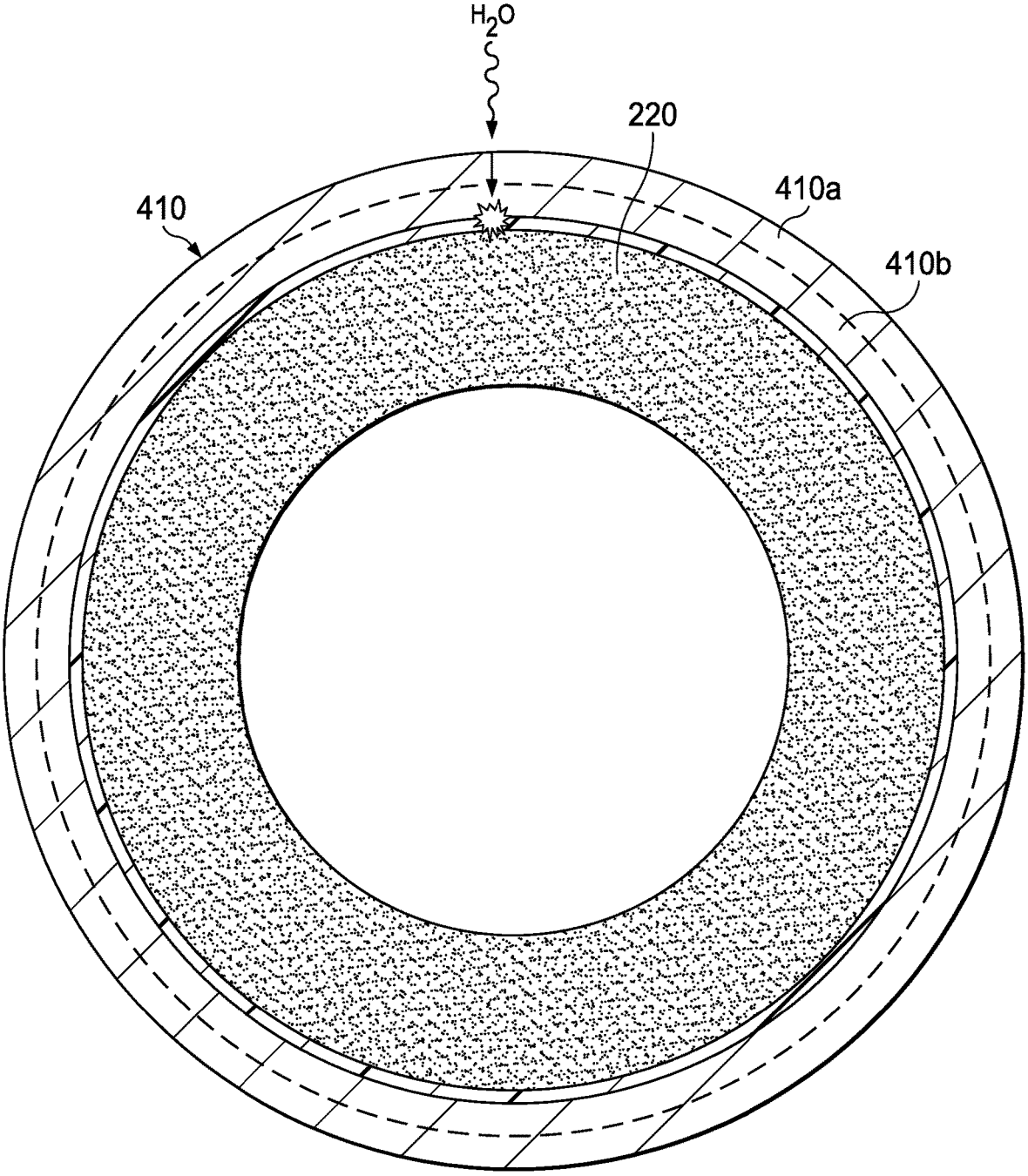
FIG. 5 illustrates an embodiment where the barrier layer coating comprises multiple layers that fully covers the expandable member.

As mentioned above, the barrier coating layer 410 may comprise multiple layers of materials 410*a* and 410*b*, as shown in FIG. 5. For example, in one embodiment, a first coating is located on the expandable member and comprises an anodizing coating and a second coating, such as a plasma electrolytic oxidation (PEO) coating, where the second coating is formed by oxidizing part of the reactive metal. In some embodiments, the coating is hydrophobic, example of which are grease or wax. The barrier layer coating 410 may be formed by physical vapor deposition, chemical vapor deposition, spraying, dipping, electrodeposition, wetting, or by auto-catalytic reactions. In other embodiments, the barrier layer coating 410 may be applied with a carrier fluid and require evaporation of the carrier fluid, such as through vacuum evaporation.

As discussed above, the barrier coating layer 410 may be layered. For example, in one embodiment, the first coating may be the above-discussed PEO coating, and a second polymer coating, as those discussed above, may be located on the first coating. In one embodiment, the multiple layers can be selected to provide a 10 hour delay of expansion of the expandable member 220 when exposed to a wellbore fluid, an example of which is a 3% KCl brine solution at 200° F. In another example of layering, a strike or flash process, a known plating technique, can be used to plate a metal, such as nickel on the expandable member 220. This plating layer forms a strong bond to the base metal that allows for the thicker layers of the barrier coating layer 410 to be quickly applied.

As mentioned above, one or more physical properties can be selected to provide a desired rate of erosion to achieve the predetermined time frame. One such physical property is porosity. In one embodiment, for example, the barrier coating layer 410 has a porosity that ranges from 0.001% to 20%. In one aspect of this embodiment, the porosity ranges from about 0.001% to about 10%. Another physical property that can be used to provide a desired rate of erosion is permeability. Thus, the material(s) of the barrier coating layer 410 can be selected to have a permeability that allows a wellbore fluid to permeate the barrier coating layer 410 within the predetermined amount of time. For example, in one embodiment, the barrier layer coating 410 has a permeability rate that ranges from 0.001 $g/m^2$/day to 1000 $g/m^2$/day of water at 200° F., and in another aspect of this embodiment, the permeability rate is 1 $g/m^2$/day of water at 200° F.

FIG. 5 illustrates an embodiment wherein the barrier coating layer 410 fully covers the surface of the expandable member 220 and comprises at least two layers 410*a* and 410*b*. This embodiment also illustrates how the wellbore fluid can permeate those layers over time to reach the surface of the expandable member 220 within the predetermined time period. The rate of permeation is dependent on one or more physical properties and or material(s), as previously mentioned. When the wellbore fluid reaches the expandable member 220, the wellbore begins to hydrolize the metal, causing it to expand, which continues until the expandable member 220 is fully expanded against the wall of the wellbore. Upon completion of the expansion, the expanded member provides a superior seal against the wellbore, particularly in those instances where the wellbore is open hole. The expandable material expands into the crevasses and irregularities of the rock formation, thereby not only forming an improved seal but also providing an improved anchoring force for the wellbore tool. The wellbore tool may be any number of downhole tools, examples of which include, a packers, anchors or plugs, that are used in various well completion processes.

Figure 6:
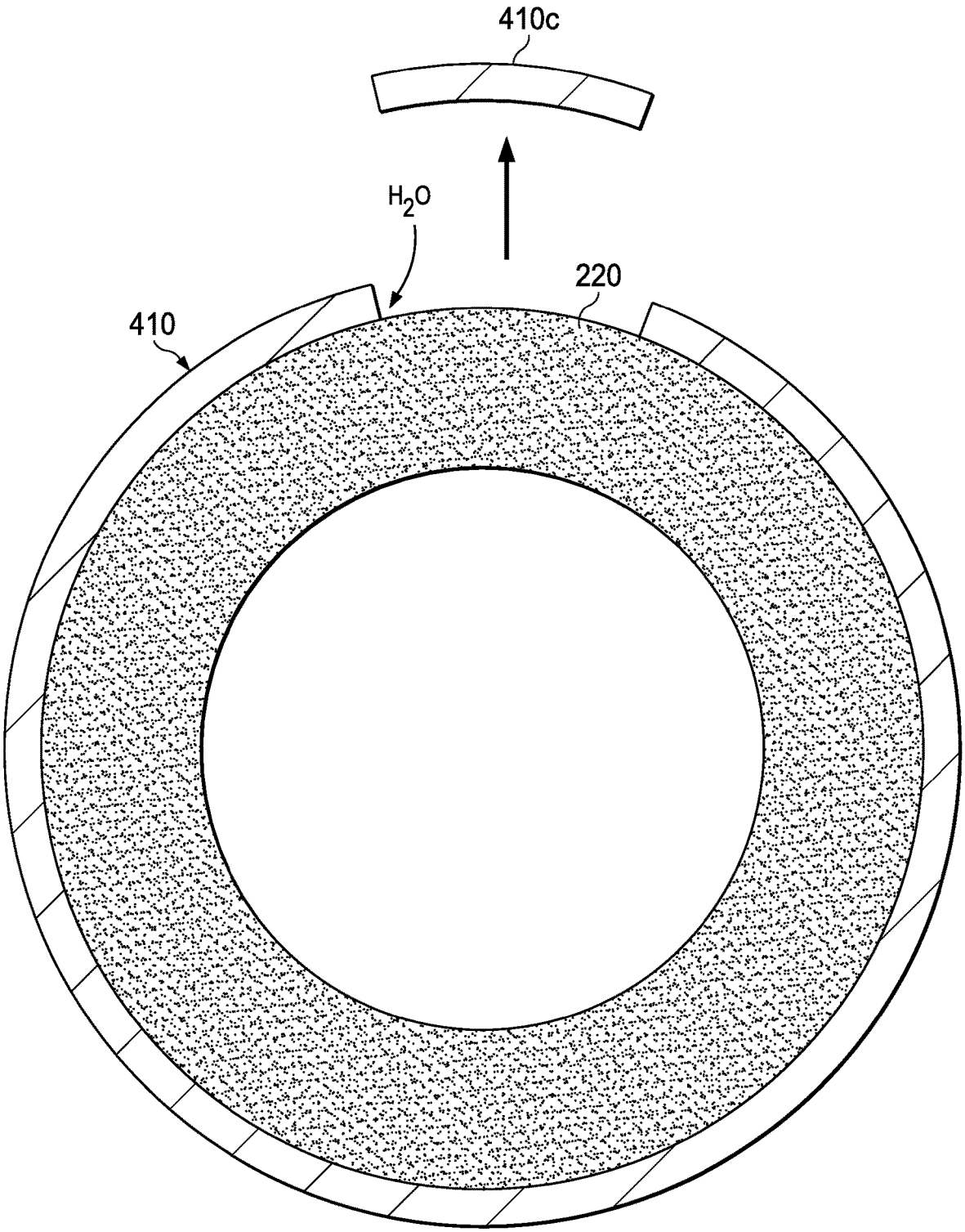
FIG. 6 illustrates the removal of the barrier coating layer as the hydrolysis of the expandable member occurs.

FIG. 6 illustrates that as the expandable member 220 expands, its expansion facilitates the erosion process as portions 410*c* of the barrier coating layer 410 begin to peel away from the surface of the expandable member 220, which can lead to the complete removal or destruction of the barrier coating layer 410 from the surface of the expandable member 220.

The invention having been generally described, the following embodiments are given by way of illustration and are not intended to limit the specification of the claims in any manner/

Embodiments herein comprise:

A wellbore tool, comprising: an expandable member positionable on a downhole conveyance member in a wellbore; wherein the expandable member comprises a metal having an outer surface and configured to expand in response to hydrolysis, and wherein a volume of the expandable member is sufficient to expand to anchor one or more downhole tools within the wellbore in response to the hydrolysis; and a barrier coating layer covering at least a portion of the outer surface of the expandable member, the barrier coating layer having a composition formulated to react with a wellbore fluid and erode within a predetermined amount of time to allow the wellbore fluid to contact and hydrolyze the expandable member.

A well system, comprising: a downhole conveyance locatable within a wellbore, one or more expandable members coupled to the downhole conveyance, wherein the one or more expandable members comprise a metal configured to expand in response to hydrolysis;

a barrier coating layer covering an outer surface of the one or more expandable members, the coating layer having a composition formulated to react with a wellbore fluid and erode within a predetermined amount of time to allow the wellbore fluid to contact and hydrolyze the one or more expandable members; and a downhole tool coupled to the one or more expandable members, wherein a combined volume of the one or more expandable members is sufficient to expand to anchor the downhole tool within the wellbore in response to the hydrolysis.

A method for setting an expandable metal wellbore anchor, comprising: positioning a downhole conveyance at a desired location within a wellbore of a subterranean formation. The downhole conveyance has an pre-expansion expandable metal wellbore anchor coupled thereto. The pre-expansion expandable metal wellbore anchor includes one or more expandable members positioned on the downhole conveyance having a barrier coating layer covering an outer surface of the one or more expandable members. The coating layer has a composition formulated to react with a wellbore fluid and erode within a predetermined amount of time to allow the wellbore fluid to contact and hydrolyze the one or more expandable members, wherein the one or more expandable members comprise a metal configured to expand in response to hydrolysis; and wherein a combined volume of the one or more expandable members is sufficient to expand to anchor one or more downhole tools within the wellbore in response to the hydrolysis; and subjecting the pre-expansion wellbore anchor to a wellbore fluid, the wellbore fluid reacting with the wellbore fluid to cause the barrier coating layer to erode at a predetermined rate to expose the one or more expandable members to the wellbore fluid and thereby expand the one or more expandable members into contact with the wellbore and thereby anchor the one or more downhole tool within the wellbore.

Element 1: wherein the metal is an alkaline earth or a transition metal.

Element 2: wherein the metal is magnesium, aluminum or calcium and the metal expands in response to one of magnesium hydrolysis, aluminum hydrolysis, calcium hydrolysis, or calcium oxide hydrolysis, respectively.

Element 3: wherein the metal is a magnesium alloy or a magnesium alloy alloyed with at least one of Al, Zn, Mn, Zr, Y, Nd, Gd, Ag, Ca, Sn, or Re.

Element 4: wherein the barrier coating layer comprises a polymer, a ceramic, an organic compound, metal, or a combination thereof.

Element 5: wherein the barrier coating layer comprises metal and the metal is nickel, gold, silver, titanium, or chrome.

Element 6: wherein the metal is nickel having a residual porosity.

Element 7: wherein the nickel is an electroless nickel on a magnesium-base alloy and has a porosity that provides a first rate of delay before an onset of expansion of the expandable member, and a second, reduced rate of expansion of the expandable member when exposed to a wellbore fluid.

Element 8: wherein the barrier coating layer comprises ceramic and the ceramic is zirconium dioxide.

Element 9: wherein the barrier coating layer comprises a polymer.

Element 10: wherein the polymer is polylactic acid, poly(glycolic acid), low density polyethylene, high density polyethylene, polypropylene, or urethane plastic.

Element 11: wherein the polymer is at least 30% crystalline.

Element 12: wherein the barrier coating layer is comprised of multiple layers.

Element 14: wherein the multiple layers is a first coating located on the expandable metal comprising an anodizing coating or plasma electrolytic oxidation coating and a second coating located on the first coating and comprising a polymer.

Element 15: wherein the multiple layers provide a 10 hour delay of expansion of the expandable metal when exposed to a well bore fluid.

Element 16: wherein the barrier coating layer has a permeability that allows a wellbore fluid to permeate the barrier coating layer within the predetermined amount of time.

Element 17: wherein the barrier coating layer has a porosity that ranges from 0.001% to 20%.

Element 18: wherein the porosity ranges from 0.001% to 10%.

Element 19: wherein the barrier coating layer has a permeability rate that ranges from 0.001 $g/m^2$/day to 1000 $g/m^2$/day of water at 200° F.

Element 20: wherein the permeability rate is 1 $g/m^2$/day of water at 200° F.

Those skilled in the art to which this application relates will appreciate that other and further additions, deletions, substitutions and modifications may be made to the described embodiments.

What is claimed is:

1. A wellbore tool, comprising:

an expandable member positionable on a downhole conveyance member in a wellbore;

wherein the expandable member comprises a metal and the expandable member has an outer surface; and a barrier coating layer covering at least a portion of the outer surface of the expandable member, the barrier coating layer having a composition formulated to react with a wellbore fluid and erode within a predetermined amount of time to allow the wellbore fluid to contact and hydrolyze the metal of the expandable member and thereby expand the expandable member in response to the hydrolysis sufficient to expand to anchor one or more downhole tools within the wellbore in response to the hydrolysis, wherein the barrier coating layer is a multilayer barrier coating layer that comprises a polymer, a ceramic, an organic compound, metal, or any combination thereof, the multilayer barrier coating layer including a first coating located on the expandable metal comprising an anodizing coating or plasma electrolytic oxidation coating and a second coating located on the first coating.

2. The wellbore tool as recited in claim 1, wherein the metal is an alkaline earth or a transition metal.

3. The wellbore tool as recited in claim 1, wherein the metal is magnesium, aluminum or calcium and the metal expands in response to one of magnesium hydrolysis, aluminum hydrolysis, calcium hydrolysis, or calcium oxide hydrolysis, respectively.

4. The wellbore tool as recited in claim 1, wherein the metal is a magnesium alloy or a magnesium alloy alloyed with at least one of Al, Zn, Mn, Zr, Y, Nd, Gd, Ag, Ca, Sn, or Re.

5. The wellbore tool as recited in claim 1, wherein the barrier coating layer comprises a barrier coating metal and the barrier coating metal is nickel, gold, silver, titanium, or chrome.

6. The wellbore tool as recited in claim 5, wherein the barrier coating metal is nickel having a residual porosity.

7. The wellbore tool as recited in claim 6, wherein the nickel is an electroless nickel on a magnesium-base alloy and has a porosity that provides a first rate of delay before an onset of expansion of the expandable member, and a second, reduced rate of expansion of the expandable member when exposed to the wellbore fluid.

8. The wellbore tool as recited in claim 1, wherein the barrier coating layer comprises ceramic and the ceramic is zirconium dioxide.

9. The wellbore tool as recited in claim 1, wherein the barrier coating layer comprises a polymer.

10. The wellbore tool as recited in claim 9, wherein the polymer is polylactic acid, poly(glycolic acid), low density polyethylene, high density polyethylene, polypropylene, or urethane plastic.

11. The wellbore tool as recited in claim 10, wherein the polymer is at least 30% crystalline.

12. The wellbore tool as recited in claim 1, wherein the first coating and the second coating provide at least a 10 hour delay of expansion of the expandable metal when exposed to the well bore fluid.

13. The wellbore tool as recited in claim 1, wherein the barrier coating layer has a permeability that allows the wellbore fluid to permeate the barrier coating layer within the predetermined amount of time.

14. The wellbore tool anchor as recited in claim 13, wherein the barrier coating layer has a porosity that ranges from 0.001% to 20%.

15. The wellbore tool anchor as recited in claim 14, wherein the porosity ranges from 0.001% to 10%.

16. The wellbore tool anchor as recited in claim 14, wherein the barrier coating layer has a permeability rate that ranges from 0.001 $g/m^2$/day to 1000 $g/m^2$/day of the water at 200° F.

17. The wellbore tool anchor as recited in claim 16, wherein the permeability rate is 1 $g/m^2$/day of the water at 200° F.

18. A well system, comprising:

a downhole conveyance locatable within a wellbore, one or more expandable members coupled to the downhole conveyance, wherein the one or more expandable members comprise a metal;

a barrier coating layer covering an outer surface of the one or more expandable members, the barrier coating layer having a composition formulated to react with a wellbore fluid and erode within a predetermined amount of time to allow the wellbore fluid to contact and hydrolyze the metal of the one or more expandable members to allow water in the wellbore fluid to contact and hydrolyze the metal of the expandable member and thereby expand the expandable member in response to the hydrolysis, wherein the barrier coating layer is a multilayer barrier coating layer that comprises a polymer, a ceramic, an organic compound, metal, or any combination thereof, the multilayer barrier coating layer including a first coating located on the expandable metal comprising an anodizing coating or plasma electrolytic oxidation coating and a second coating located on the first coating; and a downhole tool coupled to the one or more expandable members, wherein a combined volume of the one or more expandable members in response to the hydrolysis is sufficient to expand to anchor the downhole tool within the wellbore.

19. A method for setting an expandable metal wellbore anchor, comprising:

positioning a downhole conveyance at a desired location within a wellbore of a subterranean formation, the downhole conveyance having a pre-expansion expandable metal wellbore anchor coupled thereto, the pre-expansion expandable metal wellbore anchor including:

one or more expandable members positioned on the downhole conveyance having a barrier coating layer covering an outer surface of the one or more expandable members, the barrier coating layer having a composition formulated to react with a wellbore fluid and erode within a predetermined amount of time to allow the wellbore fluid to contact the one or more expandable members;

wherein the one or more expandable members comprise a metal that when contacted by the wellbore fluid undergoes hydrolysis configured to expand in response to thereby expand the one or more expandable members; and wherein a combined volume of the one or more expandable members is sufficient to expand to anchor one or more downhole tools within the wellbore in response to the hydrolysis, wherein the barrier coating layer is a multilayer barrier coating layer that comprises a polymer, a ceramic, an organic compound, metal, or any combination thereof, the multilayer barrier coating layer including a first coating located on the expandable metal comprising an anodizing coating or plasma electrolytic oxidation coating and a second coating located on the first coating; and subjecting the pre-expansion wellbore anchor to the wellbore fluid, the wellbore fluid reacting with the barrier coating layer to cause the barrier coating layer to erode at a predetermined rate to expose the one or more expandable members to the wellbore fluid and thereby expand the one or more expandable members in response to the hydrolysis and thereby contact the wellbore and anchor the one or more downhole tools within the wellbore.

* * * * *